US005667865A

United States Patent [19]

Jackson et al.

[11] Patent Number: 5,667,865

[45] Date of Patent: Sep. 16, 1997

[54] TERRY FABRIC WITH INCREASED RATE OF ABSORBENCY AND METHOD OF FORMING SAME

[75] Inventors: Timothy James Jackson, Kannapolis; Aaron Douglas Owens, Concord; Milledge Delonia Ford, China Grove; Richard Ward Rutland, Davidson; Charles Henry Shuping, Salisbury, all of N.C.

[73] Assignee: Fieldcrest Cannon, Inc., Kannapolis, N.C.

[21] Appl. No.: 672,053

[22] Filed: Jun. 26, 1996

[51] Int. Cl.[6] ..... B32B 3/02; D06M 11/38; D03D 27/08

[52] U.S. Cl. ..... 428/92; 478/85; 478/96; 478/97; 8/125; 8/537; 139/25; 139/396

[58] Field of Search ..... 428/85, 92, 97; 139/25, 396; 8/125, 537

[56] References Cited

U.S. PATENT DOCUMENTS

| | | | |
|---|---|---|---|
| 227,480 | 5/1880 | Bucknam | 8/125 |
| 1,947,103 | 2/1934 | Plumstead | 8/125 |
| 1,948,960 | 2/1934 | Daniels | 139/25 |
| 2,089,182 | 8/1937 | Branegan | 8/125 |
| 2,472,512 | 6/1949 | Benthall | 8/125 |
| 3,847,542 | 11/1974 | Harper, Jr. et al. | 8/66 |
| 4,376,632 | 3/1983 | Codecasa | 8/125 |
| 4,624,675 | 11/1986 | Irmer | 428/85 |
| 4,984,606 | 1/1991 | Moore et al. | 139/396 |
| 5,441,084 | 8/1995 | Corain et al. | 139/25 |
| 5,447,182 | 9/1995 | Gehrig | 139/25 |

*Primary Examiner*—Terrel Morris

*Attorney, Agent, or Firm*—Bell, Seltzer, Park & Gibson, P.A.

[57] ABSTRACT

A terry fabric and method of forming a terry fabric are provided in which a ground fabric is formed of ground yarns while terry yarns are interlaced with the ground yarns to form terry loops with a height substantially greater than normal (a terry yarn length greater than 4.25 inches per linear inch of ground fabric), the terry yarns being formed of singles yarns plied together with a ply twist lower than normal (ply twist lower than seven (7) turns per inch) and the singles yarns having a lower than normal twist multiple (less than 3.75). The terry fabric is partially mercerized during finishing to soften the fabric, a softener is applied of no more than about 0.4% by weight and a wetting agent is also applied to increase even further the rate of absorbency thereof.

18 Claims, 1 Drawing Sheet

TERRY FABRIC WITH INCREASED RATE OF ABSORBENCY AND METHOD OF FORMING SAME

FIELD OF THE INVENTION

The present invention relates to a terry fabric and a method of manufacturing terry fabric for use in forming towels.

BACKGROUND OF THE INVENTION

The principal use of terry fabrics is in bath, kitchen and apparel products, namely bath towels, bath sheets, hand towels, fingertip towels, wash cloths, bath robes, kitchen towels and dish cloths. A significant function of towels is the absorption of water to dry dishes, etc. or the person using the towel after a bath, shower or the like. The rate of absorbency of water is therefore an important attribute of any towel.

Many factors or characteristics of a towel affect its rate of absorbency of water. Many attempts have been made to increase the rate of absorbency in towels. Such attempts have included increasing the length of the terry loops, lowering the twist in the terry yarns and increasing the softness of the terry yarns by partial mercerization of the terry fabric. While each of these attempts, involving one, a plurality or all of these factors, has been successful in increasing the rate of absorbency to a lesser or greater extent, there has existed a need for an even greater rate of absorbency in towels.

SUMMARY OF THE INVENTION

With the foregoing in mind it is an object of the present invention to provide a terry fabric, having an increased rate of absorbency and a method of forming the same.

This object of the present invention is achieved by a terry fabric including a ground fabric formed of ground yarns, and terry yarns interlaced with the ground yarns to form terry loops on opposite faces of the ground fabric. At least the terry yarns are cotton, rayon or blends thereof and form terry loops of greater than normal length or height. The face terry yarns are formed of two singles yarns, each of which has a lower than normal twist multiple, while the terry yarns on the back of the towel are usually, but not necessarily, singles yarns. In addition, the singles yarns form the plied terry yarns and are plied together with a lower than normal ply twist. Finally, the terry fabric is partially mercerized to increase the softness thereof, and a chemical wetting agent is applied thereto.

BRIEF DESCRIPTION OF THE DRAWINGS

Some of the objects and advantages of the present invention having been stated, others will appear as the description proceeds when considered in conjunction with the accompanying drawings, in which.

DETAILED DESCRIPTION OF THE PREFERRED EMBODIMENT

Figure 1:
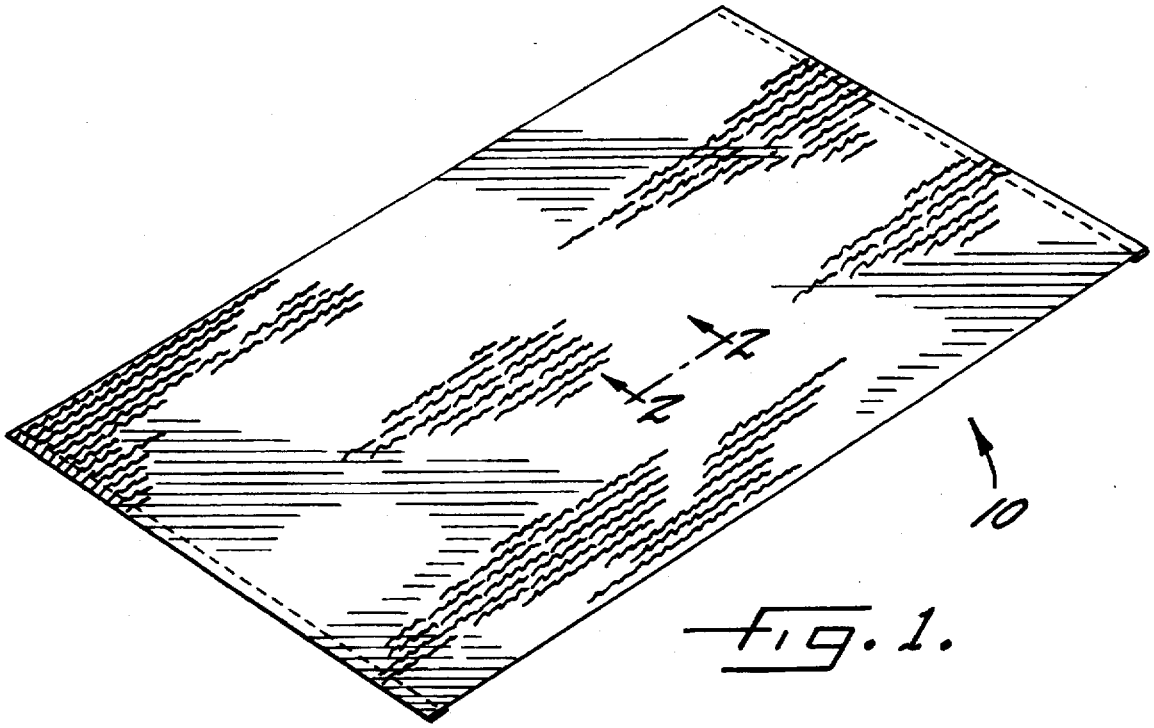
FIG. 1 is a perspective view of a towel incorporating, the features of the present invention.
Figure 2:
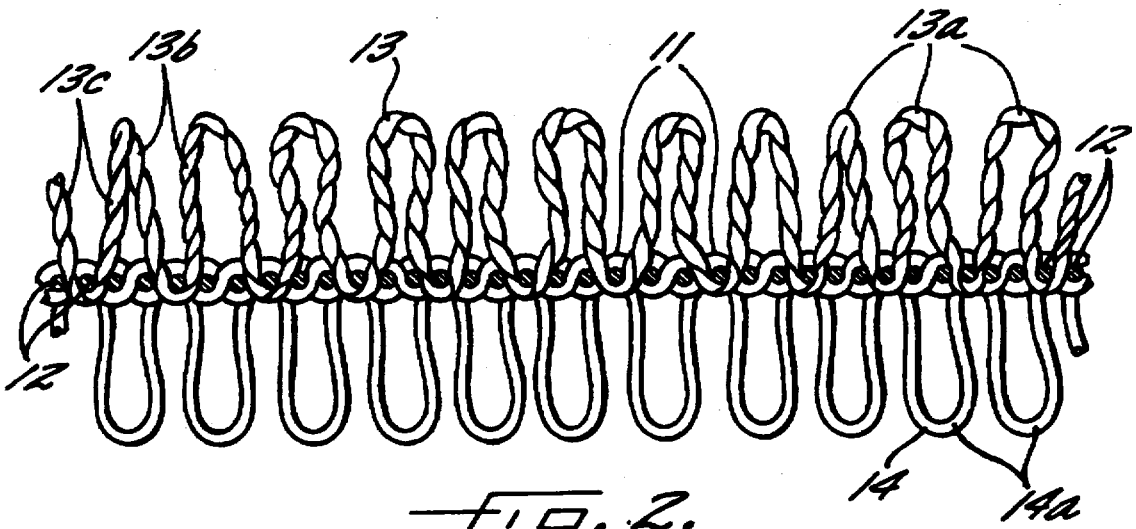
FIG. 2 is a fragmentary, enlarged sectional view taken substantially along line 2—2 in FIG. 1.

Referring now more particularly to the drawings, there is illustrated a towel 10 incorporating the features of the present invention. Towel 10 is formed of a terry fabric 10*a* which includes a ground fabric which is illustrated as being woven of ground warp yarns 11 and ground weft yarns 12. It should be understood that the terry fabric of the present invention is preferably woven, but may be knitted in a manner well known to those skilled in the textile art. The terry fabric 10*a* also includes face terry yarns 13 and back terry yarns 14 woven with the ground yarns 11 and 12 in a terry weave of any desired type, but preferably in a three-pick terry weave as illustrated in FIG. 2.

The face terry yarns 13 are woven to form terry loops 13*a* on the face of the terry fabric 10*a*, while the back terry yarns 14 are woven to form terry loops 14*a* on the back of the terry fabric 10*a*. The terry loops 13*a*, 14*a* are formed to have a length or height relative to the ground fabric greater than the normal or average height of terry loops in towels of this type. While there is no industry standard and terry loop length or height varies among towel manufacturers and, in some instances, among the various types of towels, from institutional to premium grades, it is believed that the normal or average terry loop height or length, expressed as the length of terry yarn per linear inch of the ground fabric, varies from 3.5 inches to 4.25 inches in conventional terry fabric of comparable construction. The terry loops 13*a*, 14*a* preferably have a length or height of about 5.0 inches to about 5.5 inches per linear inch of ground fabric.

The face terry yarns 13 are plied yarns, preferably of two yarns 13*b* and 13*c* plied together with a ply twist of less than seven (7) turns per inch. As with the height of terry loops, there is no industry standard for the ply twist in plied terry yarns and such ply twist may vary markedly from manufacturer to manufacturer and even from towel construction to towel construction. However, it is believed that the normal or average ply twist in towels of this general type is approximately seven (7) to nine (9) turns per inch. Preferably, the ply twist in terry yarns 13 is within the range of three (3) to five (5) turns per inch.

Each of the yarns 13*b* and 13*c* have lower than normal twist therein. Once again, there is no industry standard, but it is believed that the normal twist multiple (turns per inch= $\sqrt{\text{yarn count}}\times$twist multiple) for singles yarns plied to form terry yarns in towels of this type is 3.75 to 4.25. Preferably, the twist multiple of yarns 13*b* and 13*c* is between about 3.2 and about 3.6. Terry yarns 14 can have a lower than normal twist multiple, but in most instances, these terry yarns will have a normal twist multiple.

One example of a terry fabric 10*a* for forming towel 10 is a fabric woven on a terry loom, such as an 85" Sulzer, with ground warp yarns 11 having a yarn count of 9.5/1 and ground filling yarns 12 having a yarn count of 12.0/1, except in the borders where the filling yarns have a yarn count of 12/2. The face terry yarns 13, in this example, have a yarn count of 17/2 with back terry yarns being 9.5/1. The weave is a 3 pick terry having about 30 to 40 picks per inch and about 60 to 70 ends or warp yarns per inch.

While the foregoing terry fabric construction is preferred, it is contemplated by the present invention that both sets of terry yarns 13 and 14 can be two-ply yarns of various yarn counts having these characteristics. Moreover, the ground warp and weft yarns 11 and 12 may be of any suitable yarn counts without departing from the present invention.

In accordance with the present invention, at least terry yarns 13 and 14 are formed of cotton, rayon or blends thereof. Also, ground yarns 11 and 12 may be formed of cotton, rayon or blends thereof or may be formed of a blend or blends of the foregoing fibers with polyester staple filaments or fibers. Most preferably, terry fabric 10*a* is formed entirely of cotton fibers.

The terry fabric 10*a* for forming towel 10 is partially mercerized in accordance with the present invention by being subjected to a moderate caustic solution, stronger than the normal bleaching solutions for terry fabric, on a conventional finishing range. Preferably, the mercerizing solution is a five (5) to seven (7) percent caustic solution (normal bleaching solutions typically use a 3½% to 4% caustic solution). The partial mercerization softens the yarns 11, 12, 13 and 14, particularly the terry yarns 13 and 14. Because even partial mercerization weakens yarns considerably, it is typical in fabrics or yarns to be mercerized to increase markedly the twist multiples to offset the weakening effect of the mercerization. We have discovered that partial mercerization can be successfully achieved with an even lower than normal twist multiple in the face terry yarns 13 and/or back 14.

It is common practice in the finishing of terry fabric to add a significant amount of softener or softeners to the terry fabric to provide the requisite hand or feel to towels and the like formed therefrom. Typically, such softeners are added in an amount of about 0.5% to about 1.2% by weight of the terry fabric. While such softeners substantially improve the hand of the terry fabric, these softeners adversely affect the rate of absorbency thereof.

It has been determined that in accordance with the present invention, the addition of softeners to the terry fabric 10*a* can be significantly reduced while still achieving an acceptable hand. Preferably, a softener is added to the terry fabric 10*a* in an amount less than about 0.5% by weight, and more particularly about 0.2% to about 0.4% by weight. An anionic, nonionic, cationic or silicone softener or blends thereof may be used. However, a cationic softener is preferred.

It has also been determined by the present invention that the rate of absorbency of terry fabric 10*a* can be increased by the application of a wetting agent thereto. Such a wetting agent may be applied during finishing by being padded onto terry fabric 10*a*, along with the softener. The wetting agent may be selected from the classes of phosphated alcohols, phosphate esters, sodium sulfo-succinates, alkyl aryl sulfonates, sulfated esters, alkyl phenols, alkyl phenol ethoxylates, decyl alcohols, ethoxylated decyl alcohols, nonylphenols, ethoxylated nonylphenols or alkyl aryl ethoxylates. Preferably, the wetting agent used is a decyl alcohol and is applied in an amount of about 0.05% to about 0.2% by weight of the terry fabric 10*a*.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. A terry fabric for forming towels characterized by an increased rate of absorbency comprising:

a ground fabric formed of ground yarns, terry yarns forming terry loops on opposite sides of said ground fabric, said terry yarns having a length greater than 4.25 inches per linear inch of said ground fabric to form extra long terry loops, said terry yarns on at least one side of said terry fabric comprising a plurality of singles yarns plied together with a ply twist of less than 7 turns per inch, each of said singles yarns having a twist multiple of less than 3.75, and at least said terry yarns being partially mercerized, whereby said terry fabric has an increased rate of absorbency as compared to conventional terry fabric.

2. A terry fabric according to claim 1 wherein said terry yarns have a length within about 5.0 to about 5.5 inches per linear inch of ground fabric.

3. A terry fabric according to claim 1 wherein said plied terry yarns have a ply twist within the range of about 3 to 5 turns per inch.

4. A terry fabric according to claim 1 wherein said singles yarns forming said plied terry yarns have a twist multiple within the range of about 3.2 to about 3.6.

5. A terry fabric according to claim 1 including a softener on said terry fabric in an amount no greater than about 0.4% by weight.

6. A terry fabric according to claim 1 wherein said softener is a cationic softener.

7. A terry fabric according to claim 1 including a wetting agent on said terry fabric to increase further the rate of absorption.

8. A terry fabric according to claim 7 wherein said wetting agent is a decyl alcohol.

9. A terry fabric according to claim 8 wherein said wetting agent is in an amount of about 0.05% to about 0.2% by weight.

10. A terry fabric for forming towels characterized by an increased rate of absorbency comprising:

a ground fabric woven of warp and weft yarns, terry yarns woven with said ground fabric to form terry loops on face and back sides of said ground fabric, said terry yarns having a length within the range of about 5.0 to about 5.5 inches per linear inch of said ground fabric to form extra long terry loops, said terry yarns on the face of said terry fabric comprising a plurality of singles yarns plied together with a ply twist within the range of about 3 to about 5 turns per inch and said terry yarns on the back of said terry fabric being singles yarns, each of said singles yarns forming said plied terry yarns having a twist multiple within the range of about 3.2 to about 3.6, and said terry fabric being partially mercerized, whereby said terry fabric has an increased rate of absorbency as compared to conventional terry fabric.

11. A method of forming a terry fabric for use in forming towels having an increased rate of absorbency, said method comprising the steps of:

forming singles yarns with a twist multiple of less than 3.75, plying a plurality of singles yarns with a ply twist of less than 7 turns per inch to form terry yarns, forming a ground fabric of ground yarns while interlacing with said ground yarns said terry yarns to form terry loops on at least one side of said ground fabric, said terry yarns having a length greater than 4.25 inches per linear inch of ground fabric, to form thereby a terry fabric, and partially mercerizing said terry fabric by subjecting the same to a moderate caustic solution during finishing.

12. The method according to claim 11 wherein the singles yarns forming said plied terry yarns are formed with a twist multiple within the range of about 3.2 to about 3.6.

13. The method according to claim 11 wherein the singles yarns forming said plied terry yarns are plied with a ply twist within the range of about 3 to 5 turns per inch.

14. The method according to claim 11 wherein the terry yarns are woven to have a length within the range of about 5.0 to about 5.5 inches per linear inch of ground fabric.

15. The method according to claim 11 wherein the terry fabric is partially mercerized by being subjected to a caustic solution of about five (5) to seven (7) percent concentration.

16. The method according to claim 11 including applying to the terry fabric a softener in an amount less than about 0.5% by weight.

17. The method according to claim 15 including applying a wetting agent to the terry fabric.

18. The method according to claim 17 wherein said wetting agent is a decyl alcohol.

* * * * *